United States Patent [19]

Weston et al.

[11] Patent Number: 4,777,473

[45] Date of Patent: Oct. 11, 1988

[54] ALARM SYSTEM INCORPORATING DYNAMIC RANGE TESTING

[75] Inventors: Lance Weston, Farmingdale; Harry D. Schweiger, Melville, both of N.Y.

[73] Assignee: Fire Burglary Instruments, Inc., Hauppauge, N.Y.

[21] Appl. No.: 899,548

[22] Filed: Aug. 22, 1986

[51] Int. Cl.[4] ..... G08B 29/00

[52] U.S. Cl. ..... 340/514; 340/505; 340/511; 340/517; 340/537; 340/870.13

[58] Field of Search ..... 340/505, 506, 507-514, 340/531, 536, 537, 517, 870.13, 870.09, 870.16

[56] References Cited

U.S. PATENT DOCUMENTS

| | | | |
|---|---|---|---|
| 3,716,834 | 2/1973 | Adams | 340/505 |
| 3,882,476 | 5/1975 | Lofgren . | |
| 3,886,413 | 5/1975 | Dow et al. . | |
| 3,978,476 | 8/1976 | Tanigawa . | |
| 3,987,425 | 10/1976 | Lawton . | |
| 3,991,362 | 11/1976 | Blair et al. . | |
| 4,423,410 | 12/1983 | Galvin et al. | 340/511 |
| 4,468,664 | 8/1984 | Galvin et al. | 340/505 |
| 4,489,312 | 12/1984 | Yoshizaki | 340/514 |
| 4,506,255 | 3/1985 | Sasaki | 340/514 |
| 4,518,952 | 5/1985 | Tanaka et al. | 340/514 |
| 4,612,534 | 9/1986 | Büchler et al. | 340/505 |
| 4,613,848 | 9/1986 | Watkins | 340/505 |

*Primary Examiner*—Donnie L. Crosland

*Attorney, Agent, or Firm*—Scully, Scott, Murphy & Presser

[57] ABSTRACT

An alarm system incorporating a dynamic range testing feature whereby the system polls and tests, on a regular basis, the resistance of the circuits of alarm condition resistor elements in the alarm system, primarily to detect when the circuit of a resistor element has degraded to a pre-trouble resistance range, such that the circuit of the resistor element can be serviced and repaired prior to its degrading to a point which will trigger the alarm system. The alarm system includes a central control system, and a plurality of modules at potential alarm locations coupled by a pair of connecting lines to the central control system. Each module includes two alarm condition resistor elements associated therewith for detecting an alarm condition, which is indicated by an increase in the electrical resistance thereof, as by the opening of a switch or the breakage of a resistor element, and each module further includes a reference resistor which is provided for a reference measurement. The central control system measures the resistance of the connecting line with the reference resistor coupled thereto to enable the resistance of the connecting line to be determined. The central control system also measures the resistance of the connecting line with each alarm condition element coupled thereto during different time subperiods, to enable the resistance of each alarm condition element circuit to be determined separately.

13 Claims, 2 Drawing Sheets

ALARM SYSTEM INCORPORATING DYNAMIC RANGE TESTING

BACKGROUND OF THE INVENTION

1. Field of the Invention

The present invention relates generally to an alarm system having a capability of testing, on a regular basis, the resistance of the circuits of alarm condition resistor elements in the alarm system to detect when a circuit has degraded to a pre-trouble resistance range, such that the circuit of the resistor element can be serviced and repaired prior to its degrading to a point which will trigger the alarm system. For instance, a typical zone alarm circuit having a normal resistor element might have a resistance of from 150–450 ohms, and trigger an alarm, normally by the resistor element opening, when the resistance of the zone alarm circuit exceeds 550 ohms. This allows a pre-trouble resistance range of 450–550 ohms, which signals the necessity for service on the zone alarm circuit.

2. Discussion of the Prior Art

The prior art is replete with many diverse and different arrangements for testing the integrity of alarm systems, some of which are similar in some respects, as noted by the comments hereinbelow, to particular aspects of the present invention. For instance, Lofgren U.S. Pat. No. 3,882,476 discloses an alarm system which performs periodic tests of all alarm trigger amplifiers. Dow et al U.S. Pat No. 3,886,413 discloses an alarm system which performs a time division multiplexing of the testing mode cycle, with particular time periods corresponding to particular tests of the system. Yoshizaki U.S. Pat. No. 4,489,312 discloses a fire alarm system which tests remote fire detectors, each having a separate address code. Responsive to the receipt of the proper address, a test circuit at the detector applies a test voltage to the detector, which tests and resets the detectors. Sasaki U.S. Pat. No. 4,506,255 performs a testing sequence in which different voltage levels are applied during the testing sequence.

Tanaka et al U.S. Pat. No. 4,518,952 is also considered to be fairly pertinent to the present invention, and provides a test circuit for an alarm system having a transmission line, a plurality of terminal units connected to one end of the transmission line in a distributed manner, and a receiver connected to the other end of the transmission line. Each of the plurality of terminal units includes a sensor, an amplifier, an A/D converter, an interface, a test voltage generator, and a control circuit. A test circuit is connected between positive and negative power source terminals, and an analog output is formed of a test voltage and a normally detected voltage. This output is generated by the sensor, and is converted into a digital output by the A/D converter which is applied to the receiver when the receiver supplies its address signal and a test instruction signal to a corresponding one of the terminal units. However, this reference is also different from the present invention in several significant areas. It performs the resistance measurement at the module, rather than at the central panel, as in the present invention, the system is not interconnected by only two wires similar to the subject invention, and the modules are not supplied with all of their electrical power over those same two wires.

In general, none of the prior art discussed hereinabove discloses a concept similar to the present invention of a time division multiplexing arrangement of an addressed module wherein a reference resistor is connected across a wire line pair in one time period, and a resistor alarm circuit is connected across the wire line pair in another time period, to enable the actual resistance of the resistor alarm circuit to be measured while monitoring for a pre-trouble resistance range. Additionally, none of the prior art discussed hereinabove discloses a concept of dropping the voltage levels across the wire line pair during the actual resistance tests, for the purpose of isolating the module from the wire line pair during the tests.

SUMMARY OF THE INVENTION

Accordingly, it is a primary object of the present invention to provide an alarm system incorporating a dynamic range testing feature whereby the system polls and tests, on a regular basis, the resistance of the circuits of resistor elements in a module of the alarm system, primarily to detect when the circuit of a resistor element has degraded to a pre-trouble resistance range, such that the circuit of the resistor element can be serviced and repaired prior to its degrading to a point which will trigger the alarm system.

A further object of the subject invention is the provision of an alarm system as described wherein each module is supplied with all of its electrical power from a central control system in a unique circuit arrangement which also provides a periodic washing current through each resistor circuit to prevent a gradual deterioration of the resistor circuit contacts and connections.

In accordance with the teachings herein, the present invention provides an alarm system having the capability of testing the circuits of individual alarm condition resistor elements therein for a nonalarm generated increase in resistance. The alarm system comprises a central control system, and a plurality of modules at potential alarm locations coupled by a connecting line to the central control system. Each module includes at least one alarm condition resistor element associated therewith for detecting an alarm condition, which is indicated by an increase in the electrical resistance thereof, as by the opening of a switch or the breakage of a resistor element, and each module further includes a reference resistor which is provided for a reference measurement. Each module has an individual address code associated therewith to allow the individual modules to be addressed one at a time in individual time periods by the central control system in a time division multiplexing arrangement. Each module is responsive to the receipt of its address code from the central control system to couple the circuit of each alarm condition element and the refernce resistor to the connecting line in different time subperiods, in a further time division multiplexing arrangement.

The central control system measures the resistance of the connecting line with the reference resistor coupled thereto to enable the resistance of the connecting line to be determined. The central control system also measures the resistance of the connecting line with each alarm condition element coupled thereto during the different time subperiods, to enable the resistance of each alarm condition element circuit to be determined separately.

In greater detail, each module has two alarm condition resistor elements associated therewith, and couples the circuit of each individual alarm condition resistor element to the connecting line in an individual time subperiod associated with that element, to enable the resistance of the circuit of element to be determined. Moreover, the connecting line comprises a two wire conductor, and each module, when it is addressed by the central control system, connects the reference resistor across the two wire conductor during one time subperiod, and connects the circuit of each alarm condition element across the two wire conductor during other time subperiods.

Each module incorporates a microprocessor for controlling all of the testing and alarm operations at the module, and receives all of its electrical power for the microprocessor and other associated circuits from the two wire connecting line. To achieve this result, each module has a power capacitor associated therewith which is coupled to the connecting line for charging thereby. The central control system addresses the modules with a binary code transmitted at a first given voltage level during an initial subperiod of each time period, and each power capacitor of each module is charged to the first given voltage level during the initial time subperiod. Each module also includes a voltage regulated power supply coupled to the power supply capacitor for supplying a regulated voltage, less than the first given voltage level, to the microprocessor and the other associated circuits in the module. Moreover, an isolating diode is coupled between the connecting line and the power capacitor, and when the central control system, after the initial time subperiod, drops the voltage level on the connecting line to a second given voltage level, less than the first given voltage level, the isolating diode becomes back-biased, which isolates the power capacitor and the regulated power supply from the connecting line after the initial subperiod. A diode bridge is also coupled between the connecting line and the isolating diode, and allows either polarity voltage to pass therethrough.

Each module further includes a gate transistor coupled between the reference resistor and ground, and a gate transistor coupled between said each alarm condition resistor element and ground, and the processor connects the reference resistor and each alarm condition element to the connecting line in different time subperiods by gating on each gate transistor during the proper subperiod. Moreover, each module also has a common resistor which the processor couples to the connecting line during the beginning of each time period to indicate whether an alarm condition is present or not at that module, and when the processor does not couple the common resistor to the connecting line during the beginning of at least two consecutive time periods, it indicates to the central control system that an alarm condition is present thereat. The central control system measures the resistance of the connecting line during the beginning of each time period for an indication of an alarm condition, and takes the presence of an open circuit measurement during at least two consecutive time periods as a signal from a module of an alarm indication.

BRIEF DESCRIPTION OF THE DRAWINGS

The foregoing objects and advantages of the present invention for an alarm system incorporating dynamic range testing may be more readily understood by one skilled in the art, with reference being had to the following detailed description of a preferred embodiment theref, taken in conjunction with the accompanying drawings wherein like elements are designated by identical reference numerals throughout the several views, and in which.

DETAILED DESCRIPTION OF THE DRAWINGS

Figure 1:
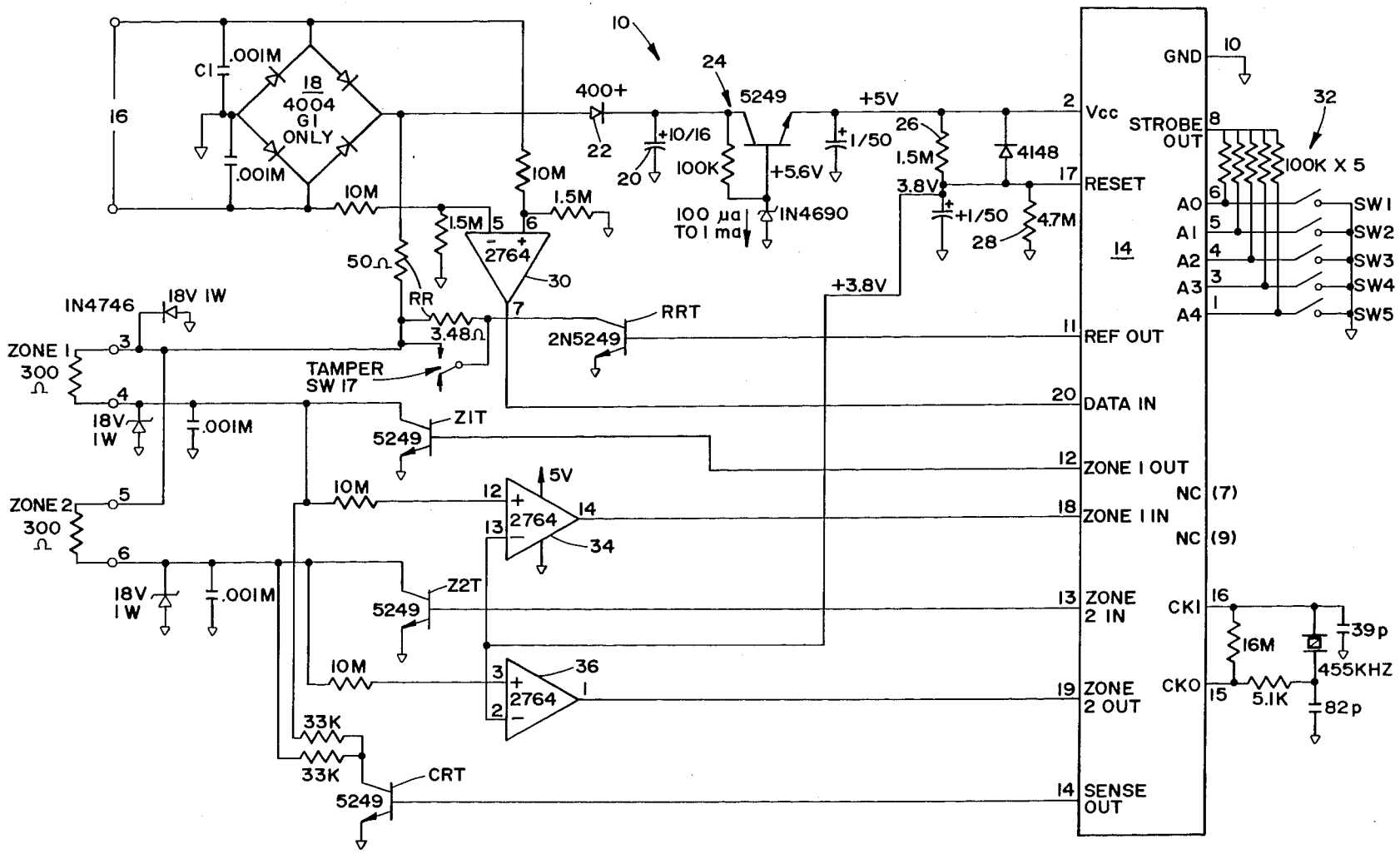
FIG. 1 illustrates one embodiment of a schematic circuit for each separate module, constructed pursuant to the teachings of the present invention.

An alarm system having a dynamic range testing feature as taught by the disclosed embodiment basically polls and tests, on a regular basis, the resistance of two resistor element circuits, designated ZONE 1 and ZONE 2 in FIG. 1, in two zones of a module 10 of an alarm system which incorporates therein a plurality of similar modules, each of which incorporates therein a microprocessor 14 based circuit similar to that of FIG. 1. Each different module 10 has a separate address code, and the central alarm system 12, FIG. 3, separately measures the resistance of each of the two zone circuits and also of a reference resistor in each polled module. The dynamic range testing feature uses a time division multiplexing arrangement for sequentially addressing the different modules, and also when testing the resistance of the two zone circuits and the reference resistor in each module.

In an exemplary embodiment disclosed herein, up to thirty-two separate modules can be addressed by a five bit Manchester code transmitted during each time period of 20 milliseconds, and each time period is divided into a number of time subperiods, as explained in greater detail hereinbelow with reference to FIG. 2. In a Manchester code, only transitions or edges of pulses are counted, with a transition (either a leading or lagging edge) designating one bit, e.g. one, and the lack of a transition designating an opposite bit, e.g. zero.

A testing circuit at a central panel of the alarm system sequentially polls each of the modules in the alarm system by sequentially addressing each module in turn. A five bit Manchester code (transmitted between +10 V and −10 V states) is utilized to address each module, and when a module receives its proper address code, it is tested by a time division multiplexing arrangement in which a processor 14 at the module responds to its proper address code by connecting the ZONE 1 circuit across the pair of wire lines 16 connecting the module 10 to the alarm system in a first time subperiod, connecting the ZONE 2 circuit across the alarm system pair of wire lines in a second time subperiod, and connecting a 398 ohm reference resistor across the alarm system pair of wire lines in a third time subperiod. The processor sequentially energizes (shorts) three transistors connected between the three circuits and ground to consecutively place each of the three circuits across the pair of wire lines.

In the illustrated embodiment, the reference resistor RR actually comprises a series pair of resistors of 50 ohm and 348 ohm. The 348 ohm resistor is placed in parallel with a tamper switch 17 which is associated with a cover for the module. When the cover is properly in place, the switch 17 is open as illustrated in FIG. 1, and RR equals the series sum of two resistors, 398 ohms. However, when the cover is removed, indicating possible tampering with the module, the switch 17 closes to short across the 348 ohm resistor, thus changing the value of RR to only 50 ohms, which is then detected at the central panel 12, alerting the central unit as to possible tampering at the module.

The central alarm system measures the voltage across the wire pair in each of the three time subperiods. The measurement with the 398 ohm reference resistor allows the resistance of the circuit of the pair of wire lines (Rline) to be determined. The measurement of the voltage with the zone 1 circuit connected is a measurement of Rzone 1 and Rline in series, and with Rline determined, allows a determination of Rzone 1, and likewise for Rzone 2. In practice, the voltage measurements across the line are converted to resistance values by a table in memory in the processor operated central control system at the central panel of the alarm system.

Figure 2:
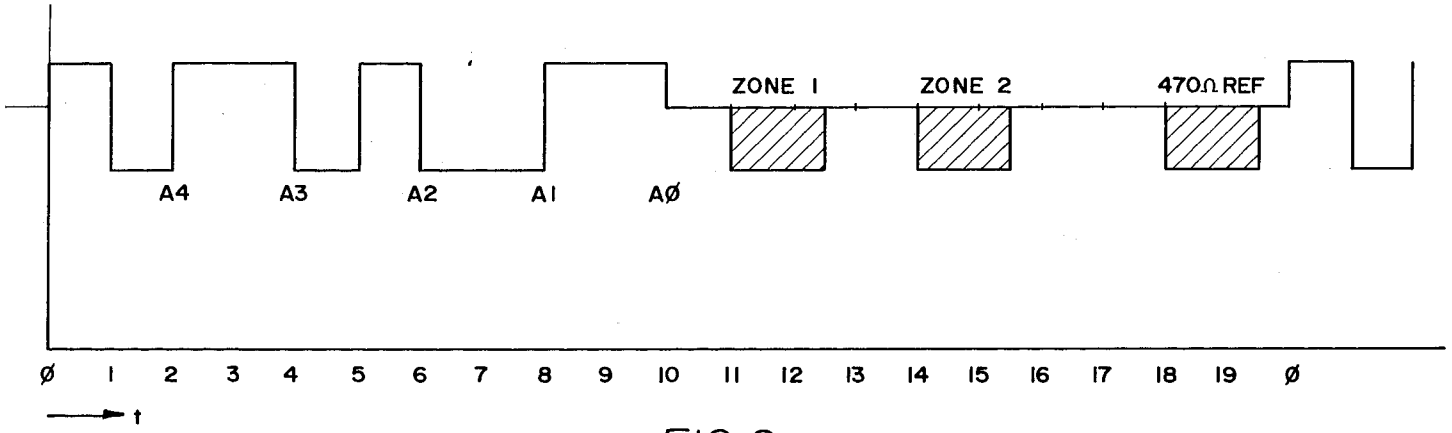
FIG. 2 illustrates exemplary waveforms which are useful in explaining the operation of the subject invention.

Referring to FIG. 2, a 30 millisecond time period is illustrated, wherein in the first millisecond time subperiod, the central control system places a +10 V signal on the pair of wire lines 16 connecting all of the modules to the central control system. During this first one millisecond time subperiod, every module in the alarm system is either testing both zones therein for an alarm condition or is signalling the detection of an alarm condition to the central control panel, as explained in greater detail hereinbelow. Next, during the second through tenth millisecond time subperiods, the central control system transmits a particular five bit Manchester code over the common wire lines 16, addressing one particular module of a possible total of thirty-two modules. During the eleventh and first one half of the twelfth millisecond time subperiods, the resistance of the ZONE 1 resistance loop of the particular addressed module is tested. During the fourteenth and first one half of the fifteenth millisecond time subperiods, the resistance of the ZONE 2 resistance loop of the particular addressed module is tested. Finally, during the eighteenth and first one half of the nineteenth millisecond time subperiods, the resistance of the line with a 398 ohm reference resistor RR placed thereacross is measured, which allows the resistance of the line (Rline) to be determined.

Following the twentieth millisecond time period, the next twenty millisecond time period is started, wherein the same operation is repeated, but with the next Manchester encoded code for the next module to be tested.

Referring to FIG. 1, the line pair 16 is connected to each module by a diode bridge 18, which allows either polarity voltage to pass therethrough during the measurements, thereby preventing a module from being connected with an improper polarity. During the the first ten milliseconds of each time period, a power capacitor 20 in each module is initially charged to +10 volts by the rectified output of the diode bridge 18, after which the line voltage across the lines 16 is dropped to +5 volts, which backbiases an isolation diode 22 to effectively remove the module control circuit from the line while the three resistance measurements are being taken during the tenth through twentieth milliseconds of each time period. Thus, the charged power capacitor 20 then forms the power supply for that module, and is constantly recharged during the beginning 10 milliseconds of each 20 millisecond time period.

After the Manchester address code is transmitted during the first 10 millisecond portion of each 20 millisecond time period, the line voltage across the lines 16 is dropped to approximately ±5 volts. This results in the isolation diode 22 being backbiased, such that the diode 22 isolates all of the circuitry to the right thereof, including the regulated power supplies for the transistors, the 2764 comparator amplifiers and the processor 14, from the line voltages during the remainder of the 20 millisecond time period, during which the actual line voltage and resistance measurements for ZONE 1, ZONE 2, and the reference resistor RR are taken.

The +10 V across the capacitor 20 is converted to a +5.0 V regulated power supply by the regulated power supply circuit 24 to supply a regulated +5.0 V, and a pair of voltage divider resistors 26, 28 then supply a regulated +3.8 V power supply to remaining sections of the circuit.

The Manchester address code on the supply line 16 passes through the 2764 comparator amplifier 30 to the processor 14, to enable the processor to read the code to determine if it is its own address, which is set at 32 by the five switches and five 100K resistors switched in or out thereby, such that each processor has a five bit binary address code to enable thirty-two separate addresses for thirty two different modules.

The processor 14 can switch on four different switching transistors, a Reference Resistor Transistor (RRT) for the reference resistor RR, a Zone 1 Transistor (Z1T) for the ZONE 1 circuit, a Zone 2 Transistor (Z2T) for the ZONE 2 circuit, and a Common Resistor Transistor (CRT) for the two 33KΩ common resistors, by selectively supplying voltages to the four gates thereof.

Each and every module of the alarm system tests the integrity of its zone 1 resistance loop and its zone 2 resistance loop during the first millisecond subperiod of each 20 millisecond time period. During the first millisecond subperiod, the central control system places a ±10 V signal across the two common wires 16 connected to all of the modules, such that a +10 V signal is placed on the right side of the diode bridge in each module. The processor within each module normally turns on the transistor CRT during that first millisecond subperiod, and if the resistance elements in the first and second zones are in a nonalarm condition, the +10 V passes therethrough to the + input of the two comparator amplifiers 34, 36. The − input of each comparator amplifier is coupled to a reference +3.8 V input from the power supply, such that each comparator amplifier produces a positive output to the processor, signifying thereto a nonalarm condition of the resistive element in that particular zone.

In contrast thereto, when an alarm condition is present signified by an open resistive element (Rzone1 or Rzone2) the +10 V signal does not pass through the resistance element, such that a 0 V signal is present on the + input to the comparator amplifier. The reference +3.8 V input into the − input of the comparator amplifier results in a negative voltage signal being present at its output, which signals to the processor the presence of an alarm condition in that particular zone. During normal operation of each module circuit, when an alarm condition is not sensed, the transistor CRT is gated on during the first one millisecond time subperiod within each and every different module. If a module senses an alarm condition during three consecutive 20 millisecond time periods, it does not gate the transistor CRT on during the first one millisecond time subperiods of the next three consecutive 20 millisecond time periods, which presents an open circuit by that module across the two common lines 16 during those three time periods. The open circuit is detected during the three consecutive time periods by the central alarm system by its voltage and resistance measurements at the central control system, which it recognizes as an alarm signal and triggers an alarm. In this arrangement, an alarm is triggered, but the central panel, at least initially, does not know which module triggered the alarm system until after that module is addressed and tested as discussed hereinabove.

A commercial embodiment of the present invention is capable of scanning thirty-two separate modules, with each module scan taking 20 milliseconds, which results in a complete scan of all modules in 640 milliseconds. It is desirable to have each module report an alarm condition at least twice, for redundantly ensuring accurate operation, prior to the system recognizing an alarm condition as valid. If each module reported an alarm condition only during its 20 millisecond time period, the system would require 1280 milliseconds (about 1⅓seconds) to complete two scans to recognize an alarm condition as valid. This period of time is too long as a door can be opened and closed in less than that period of time.

Accordingly, the present invention takes a different approach, and each and every module uses the first millisecond subperiod of every 20 millisecond time period to measure for an open circuit (e.g. opening of a door associated switch or breaking of a window associated resistor) indicative of an alarm condition. Each module must detect an alarm condition for three consecutive 20 millisecond time periods (such that an alarm condition is detected over a 60 millisecond time period) prior to reporting the alarm condition to the central alarm system, which it does over the next three consecutive 20 millisecond time periods by not gating on its transistor CRT (such that an alarm conditon is reported over a 60 millisecond time period). This results in a total detection and reporting time period of 120 milliseconds, or slightly longer that a tenth of a second.

When a module receives its proper address via the Manchester code, during the zone 1 period, the processor gates the zone 1 transistor Z1T on, thereby connecting the zone 1 resistor across the two common lines 16. Likewise, during the zone 2 period, the processor gates the zone 2 transistor Z2T on, thereby connecting the zone 2 resistor across the two common lines 16, and during the reference resistor period, the processor gates the reference resistor transistor RRT, thereby connecting the 398 ohm reference resistor RR across the two common lines. During these measurements, the central control system actually measures the voltage across the lines 16, and utilizes a table in memory to obtain the corresponding resistance.

Figure 3:
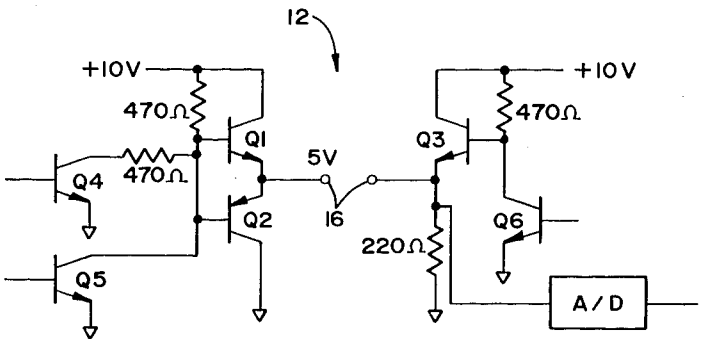
FIG. 3 is a schematic circuit of one embodiment of a test circuit at the central control panel of the alarm system.

FIG. 3 is a schematic of a portion of the test circuit at the central control panel of the alarm system, and illustrates the common line pair 16, one terminal of which is connected in a voltage divider relationship between transistors Q1 and Q2, and the second terminal of which is connected in a voltage divider relationship between transistor Q3 and a 220 ohm resistor. This circuit is utilized to transmit digital data during the first ten milliseconds of each period, and reads analog data and converts it to digital data by an A/D converter during the tenth to twentieth milliseconds of each period.

Digital data is transmitted by selectively turning on either transistor Q5 or Q6, with Q4 off, with transistor Q5 being on and transmitor Q6 being off on to transmit a high level, and transistor Q6 being on and transistor Q5 being off to transmit a low level, as shown in the first 10 milliseconds of FIG. 2. At the end of the first 10 milliseonds, transistors Q4 and Q6 are turned on and transistor Q5 off, which presents half of the supply voltage at the emitters of Q1 and Q2. On the second line 16, a 220 ohm resistor connects the line to ground. The circuit then measures the impedance across the terminals 16 by measuring the voltage across the 220 ohm resistor.

Moreover, the circuits herein also provide a periodic washing current through each resistor circuit to prevent a gradual deterioration of the resistor circuit contacts and connections. A relatively small washing current is provided to all resistor circuits during the first millisecond of each period, and when a particular module is addressed, the zone 1 circuit and zone 2 circuit therein is each provided with a washing current during the respective zone 1 and zone 2 measurements.

While a preferred embodiment and several variations of the present invention for an alarm system incorporating dynamic range testing are described in detail herein, it should be apparent that the disclosure and teachings of the present invention will suggest many alternative designs to those skilled in the art. For instance, the number of modules, the number of resistor element circuits therein, and the length and frequency of the time periods could be modified in different embodiments and variations of the subject invention.

What is claimed is:

1. An alarm system having the capability of testing individual alarm condition elements therein for an increase in resistance not generated by an alarm condition, said alarm system comprising a central control system, and a plurality of modules at potential alarm locations coupled by a connecting line to the central control system, each module having at least one alarm condition resistive element associated therewith for detecting an alarm condition, which is indicated by an increase in the electrical resistance of the alarm condition resistive element, as by the opening of a switch or the breakage of a resistor element, each module having an individual address code associated therewith to allow the individual modules to be addressed one at a time in individual time periods by the central control system in a time division multiplexing arrangement, and each module including a reference resistor, and being responsive to the receipt of its address code from the central control system over the connecting line to couple the reference resistor to the connecting line in one time subperiod, and to couple the circuit of at least one alarm condition resistive element to the connecting line in another time subperiod in a further time division multiplexing arrangement, and said central control system measuring the resistance of the connecting line with the reference resistor coupled thereto during said one time subperiod to enable the resistance of the connecting line to be determined, and measuring the resistance of the connecting line with the circuit of at least one alarm condition resistive element coupled thereto during said another time subperiod, to enable the resistance of the circuit of the alarm condition resistive element to be determined.

2. An alarm system as claimed in claim 1, each module having at least two alarm condition resistive elements associated therewith, and coupling each individual alarm condition resistive element to the connecting line in an individual time subperiod associated with that element, to enable the resistance of each individual alarm condition resistive element to be determined.

3. An alarm system as claimed in claim 1, said connecting line comprising a two wire conductor, and each module, when it is addressed by the central control system, connecting the reference resistor across the two wire conductor during said one time subperiod, and connecting the at least one alarm condition element across the two wire conductor during said another time subperiod.

4. An alarm system as claimed in claim 1, each module having a processor for controlling operations at the module.

5. An alarm system as claimed in claim 1, each module receiving electrical power for the operation of its module circuits from the connecting line.

6. An alarm system as claimed in claim 5, each module having a power capacitor associated therewith which is coupled to the connecting line for charging thereby to supply electrical power for all of the circuits of the module.

7. An alarm system as claimed in claim 6, said central control system addressing the modules with a binary code transmitted at first given voltage level during an initial subperiod of each time period, and each module having a voltage regulated power supply coupled to said power supply capacitor for supplying a regulated voltage, less than said first given voltage level, to the circuits in the module.

8. An alarm system as claimed in claim 7, each module having an isolating diode coupled between the connecting line and the power capacitor, and the central control system, after the initial subperiod, dropping the voltage levels on the connecting line to second given voltage levels, less than said first given voltage levels, such that the isolating diode becomes back biased and isolates the power capacitor and regulated power supply from the connecting line following the initial subperiod.

9. An alarm system as claimed in claim 8, including a diode bridge coupled between the connecting line and the isolating diode, which allows either polarity voltage to pass therethrough.

10. An alarm system as claimed in claim 4, including a gate transistor coupled between said reference and ground, a gate transistor coupled between each alarm condition resistive element and ground, and said processor connecting said reference resistor and each alarm condition resistive element to the connecting line in each subperiod by gating on each gate transistor during the proper subperiod.

11. An alarm system as claimed in claim 1, each module having a common resistor which is coupled to the connecting line during a subsequent at the beginning of each time period to indicate that an alarm condition is not present at that module, and which is not coupled to the connecting line during the beginning of at least two consecutive time periods to indicate that an alarm condition is present at that module, and the central control system measuring the resistance of the connecting line during the subperiod at the beginning of each time period for an indication of an alarm condition, and taking the presence of an open circuit measurement during at least two consecutive time periods as an indication of an alarm condition.

12. An alarm system as claimed in claim 11, wherein each module measures the resistance of each alarm condition resistive element during said subperiod at the beginning of each time period.

13. An alarm system having the capability of testing individual alarm condition elements therein for a non-alarm generated increase in resistance as claimed in claim 1, said reference resistor having a tampering switch associated therewith, with the state of the tampering switch indicating possible tampering with the module and changing the resistance value of said reference resistor.

* * * * *